US009004649B2

(12) United States Patent
Cho et al.

(10) Patent No.: US 9,004,649 B2
(45) Date of Patent: Apr. 14, 2015

(54) PRINTING DEVICE

(71) Applicant: Samsung Display Co., Ltd., Yongin, Gyeonggi-Do (KR)

(72) Inventors: Sung-Hwan Cho, Yongin (KR); Sang-Jo Lee, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 0 days.

(21) Appl. No.: 13/915,796

(22) Filed: Jun. 12, 2013

(65) Prior Publication Data

US 2014/0008463 A1 Jan. 9, 2014

(30) Foreign Application Priority Data

Jul. 5, 2012 (KR) ..... 10-2012-0073552

(51) Int. Cl.

| | |
|---|---|
| ***B41J 2/04*** | (2006.01) |
| ***B41J 2/17*** | (2006.01) |
| ***B41J 2/18*** | (2006.01) |
| ***B41F 17/00*** | (2006.01) |

(52) U.S. Cl.

CPC ..... *B41F 17/00* (2013.01)

(58) Field of Classification Search

None

See application file for complete search history.

(56) References Cited

FOREIGN PATENT DOCUMENTS

| | | |
|---|---|---|
| JP | 2003-291374 | 10/2003 |
| KR | 100773554 | 10/2007 |

OTHER PUBLICATIONS

Machine Translation of JP 2003291374.*
Machine Translation of KR 100773554.*

* cited by examiner

*Primary Examiner* — Lisa M Solomon
(74) *Attorney, Agent, or Firm* — Robert E. Bushnell, Esq.

(57) ABSTRACT

A printing device includes a solution tank, a nozzle unit including a distribution path and a plurality of nozzles connected with the distribution path the nozzle unit being connected with the solution tank through a first pipe; a gas supply connected with the nozzle unit through a second pipe; and a discharge unit connected with the nozzle unit through a third pipe, wherein the distribution path includes first portions and second portions that respectively have different widths.

20 Claims, 5 Drawing Sheets

PRINTING DEVICE

CLAIM OF PRIORITY

This application makes reference to, incorporates the same herein, and claims all benefits accruing under 35 U.S.C. §119 from an application earlier filed in the Korean Intellectual Property Office on the $5^{th}$ of Jul. 2012 and there duly assigned Serial No. 10-2012-0073552.

BACKGROUND OF THE INVENTION

1. Field of the Invention

The described technology relates generally to a printing device. More particularly, the described technology relates generally to a printing device for manufacturing a display device.

2. Description of the Related Art

In order to form a color filter of a liquid crystal display (LCD) and a layer of an organic electroluminescent (EL) device, a printing method for discharging a solution including a functional material is used.

The printing method may use a printing device that discharges a solution, and the printing device presses a solution tank to transmit the solution to a nozzle such that a liquid-state material is discharged.

The nozzle of the printing device is vulnerable to particles because the nozzle has a very small diameter so that a clog may be formed in the nozzle. In addition, air enters in the solution tank when the solution tank is exchanged so that bubbles are often formed.

In this case, the particles or bubbles can be eliminated by applying a strong pressure toward the peak end direction of the nozzle, but the diameter is narrowed toward the inlet of the nozzle so that the particles or the bubbles cannot be easily eliminated even though a strong pressure is applied.

The above information disclosed in this Background section is only for enhancement of understanding of the background of the described technology and therefore it may contain information that does not form the prior art that is already known in this country to a person of ordinary skill in the art.

SUMMARY OF THE INVENTION

The described technology has been made in an effort to provide a printing device that can easily eliminate particles or bubbles in a nozzle even through the nozzle has a gradually narrowed diameter.

A printing device according to an exemplary embodiment includes: a solution tank; a nozzle unit including a distribution path connected with the solution tank through a first pipe and a plurality of nozzles connected with the distribution path; a gas supply connected with the nozzle unit through a second pipe; and a discharge unit connected with the nozzle unit through a third pipe, and the distribution path includes first portions and second portions that respectively have different widths.

The first portions may correspond to the nozzles and the second portions may correspond between the nozzles.

The width of the first portion may be larger than the width of the second portion.

A ratio of the width of the first portion and the width of the second portion may be 10:8.2 to 9.

The width of the second portion may be gradually changed or may be gradually narrowed toward the third pipe.

A ratio of the width of the first portion and the smallest width of the second portion may be 10:8.2 to 9.

The distribution path may include an inclined portion inclined with respect to an upper surface connected with the first pipe.

An angle formed by an extended inclined surface of the inclined portion and the upper surface may be less than 30°.

The inclined surface may have a curved surface.

The inclined surface may form steps, and the widths of the steps may be spaced apart from each other at regular intervals.

The width of each step may be gradually changed.

The particles or bubbles in the nozzles can be easily eliminated using the printing device according to the present invention.

Thus, the printing device can be used for a longer period of time by reducing the nozzle damage, and the increase of the process time can be minimized by shorting time for eliminating the particles.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
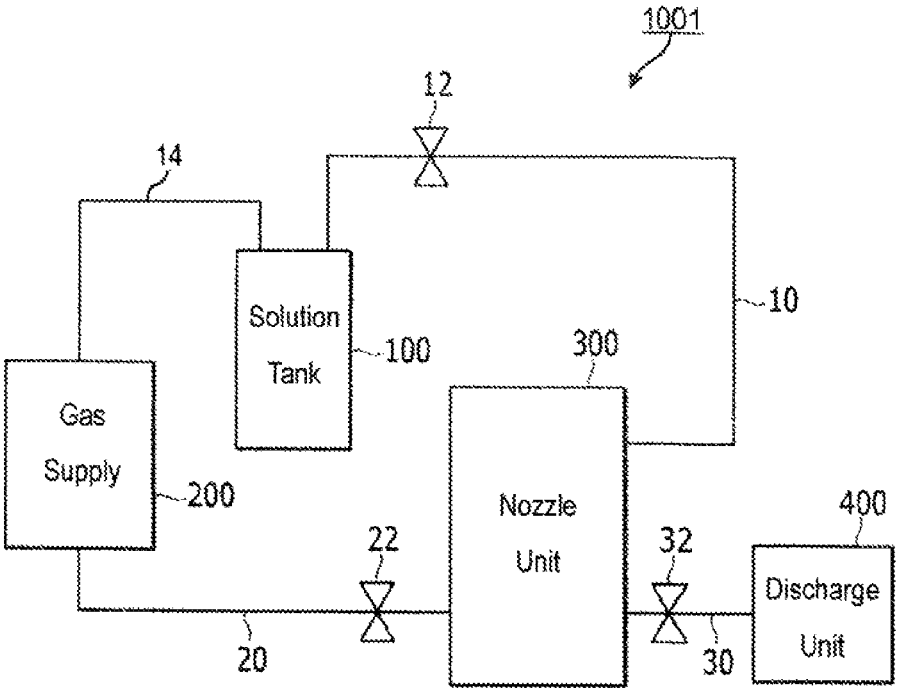
FIG. 1 is a schematic block diagram of a printing device according to an exemplary embodiment.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

In the drawings, the thickness of layers, films, panels, regions, etc., are exaggerated for clarity. In addition, in the drawings, for understanding and ease of description, the thickness of some layers and areas is exaggerated. It will be understood that when an element such as a layer, film, region, or substrate is referred to as being "on" another element, it can be directly on the other element or intervening elements may also be present.

In addition, unless explicitly described to the contrary, the word "comprise" and variations such as "comprises" or "comprising", will be understood to imply the inclusion of stated elements but not the exclusion of any other elements. Further, it will be understood that when an element such as a layer, film, region, or plate is referred to as being "on" another element, it can be directly on the other element or intervening elements may also be present.

Hereinafter, a printing device according to an exemplary embodiment will be described in further detail with reference to FIG. 1 and FIG. 2.

Figure 2:
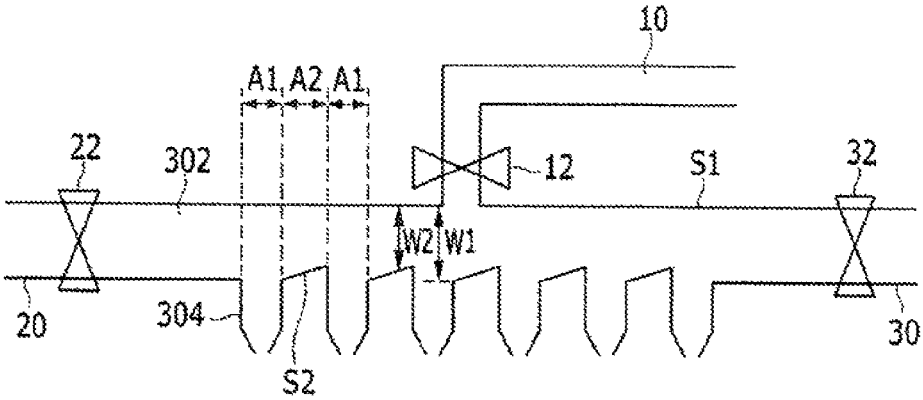
FIG. 2 is an enlarged cross-sectional view of a nozzle portion of FIG. 1.

FIG. 1 is a schematic block diagram of a printing device according to an exemplary embodiment, and FIG. 2 is an enlarged cross-sectional view of a nozzle unit of FIG. 1.

As shown in FIG. 1, a printing device 1001 according to the exemplary embodiment includes a solution tank 100, a gas supply 200 connected with the solution tank 100, a nozzle unit 300 and a discharge unit 400.

The solution tank 100 contains a solution to be sprayed through a nozzle.

The solution tank 100 is connected with the nozzle unit 300 through a first pipe 10, and a valve 12 and a mass flow measuring device (not shown) are connected to the first pipe 10 to control the flow of the solution transmitted to the nozzle unit 300 from the solution tank 100.

The gas supply 200 is connected with the solution tank 100 through a pipe 14 to emit the solution in the solution tank 100 by pressing the solution with a pressure range of 1 to 10 psi. In this case, the gas may be nitrogen gas.

In addition, the gas supply 200 is connected with the nozzle unit 300 through a second pipe 20 to control the amount of gas supplied to the nozzle unit 300 using the valve 22.

The nozzle unit 300 includes a distribution path 302, described in detail with reference to FIG. 2, connected with the first pipe 10 and a plurality of nozzles 304. Lateral ends of the distribution path 302 are respectively connected with the second pipe 20, using the valve 22, and a third pipe 30, using a valve 32.

As shown in FIG. 2, the nozzle unit 300 includes the distribution path 302 connected with the solution tank 100 through the first pipe 10 and the plurality of nozzles 304 connected with the distribution path 302.

Lateral ends of the distribution path 302 are respectively connected with the second pipe 20 through which the gas is taken in and the third pipe 30 through which the gas is emitted.

In the distribution path 302, widths W1 of first portions A1 that correspond to the respective nozzles 304 are equivalent to each other, and a width W2 of the second portion A2 disposed between the nozzles 304 is gradually increased or decreased. That is, the distribution path 302 disposed in the second portion A2 includes an inclined portion S2 obliquely inclined with respect to an upper surface S1 of the distribution path 302 connected with the first pipe 10. In this case, the first portion A1 may be equivalent to the width of a portion connected with the second pipe or the third pipe.

In this case, a ratio of the width W1 of the first portion A1 and the smallest width W2 of the second portion A2 may be W1:W2=10:8.2 to 9, and an angle formed by an extended inclined surface of the inclined portion S2 and the upper surface S1 of the distribution path 302 may have a slope less than 30°.

As in the exemplary embodiment, when the width of the distribution path 302 is periodically increased, or decreased, the particles and bubbles in the nozzles can be easily eliminated using an eddy current formed due to a pressure difference of gas flowing into the distribution path.

Referring back to FIG. 1, the third pipe 30 is connected with the discharge unit 400. The discharge unit 400 collects particles in the nozzle unit and gas entered in the nozzle unit, and separates the gas and the particles for recycling of the gas.

Next, a method for eliminating particles and bubbles in the printing device of the FIG. 1 and FIG. 2 will be described in further detail with reference to FIG. 3.

Figure 3:
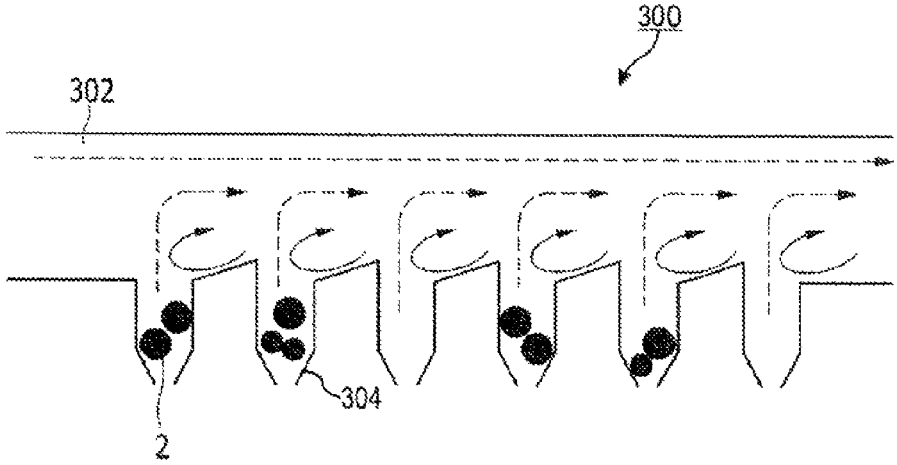
FIG. 3 is provided for describing a method for eliminating particles according to the exemplary embodiment.

FIG. 3 is provided for description of a method for eliminating particles according to the exemplary embodiment.

FIG. 3 simulates the valve 12 of the first pipe 10 supplying the solution to the distribution path 302 of the nozzle unit 300 being closed to eliminate particles 2 existing in the nozzles 304. Thus, no solution is supplied to the nozzle unit 300.

FIG. 3 also simulates the valves 22 and 32 of the second and third pipes 20 and 30 being opened to supply the gas to the distribution path 302 of the nozzle unit 300 and exhaust the gas therefrom.

Then, the gas enters into the nozzle unit 300 through the second pipe 20 and passes through the distribution path 302, and then the gas is discharged through the third pipe 30 connected to the end of the distribution path 302.

As in the exemplary embodiment, when the width of the distribution path 302 is changed, the gas entered into the distribution path flows to an outlet such that a pressure difference is generated in the distribution path due to the width variation of the distribution path.

Such a pressure difference causes the gas to flow with high speed in a portion having a wide width from a portion having a narrow width, thereby forming an eddy current, and the particles 2 are sucked from the nozzles 304 and accelerated to move toward the distribution path 302 (dashed line arrows) by the eddy current (circular arrows) and then the particles 2 are discharged from the nozzle unit together with the gas moving to the discharge unit 400 through the distribution path.

In this case, the strength of the eddy current is increased as the flow amount or the flow speed of the injected gas is increased, and therefore the flow amount or the flow speed of the gas can be changed according to an elimination state of the particles 2.

When the particles 2 are wholly eliminated, the valves of the second and third pipes 20 and 30 are closed to prevent no further gas flow, and then, the valve of the first pipe 10 is opened for inflow of the solution.

The inclined portion S2 on the exemplary embodiment of FIG. 1 is illustrated as a straight line, but the inclined portion may have various shapes as shown in FIG. 4 to FIG. 10.

Hereinafter, a printing device according to other exemplary embodiments will be described with reference to FIG. 4 to FIG. 10.

FIG. 4 to FIG. 10 are cross-sectional views of a nozzle unit according to other exemplary embodiments.

Figure 4:
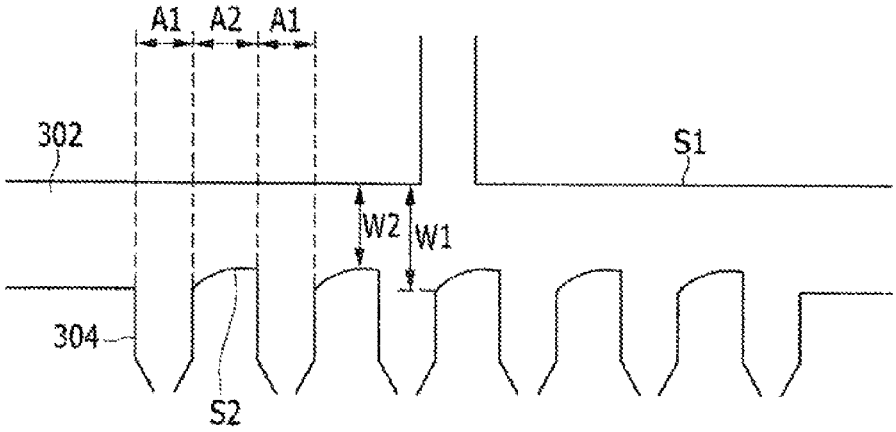
FIG. 4 to FIG. 10 are cross-sectional views of a nozzle portion according to other exemplary embodiments.

The exemplary embodiment illustrated in FIG. 4 is substantially the same as the exemplary embodiment illustrated in FIG. 2, except that an inclined portion S2 has a curved shape, and therefore a repeated description will be omitted.

As shown in FIG. 4, the inclined portion S2 of a distribution path 302 has a bent curved shape.

Figure 5:
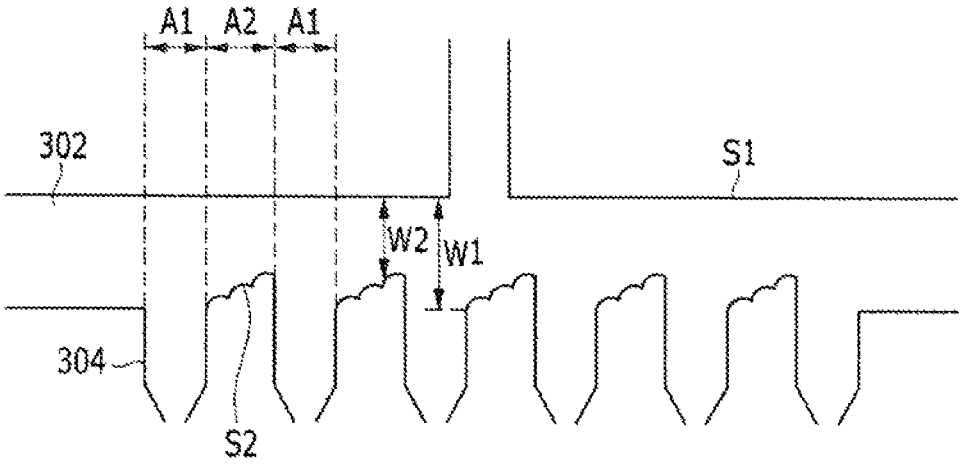
Figure 6:
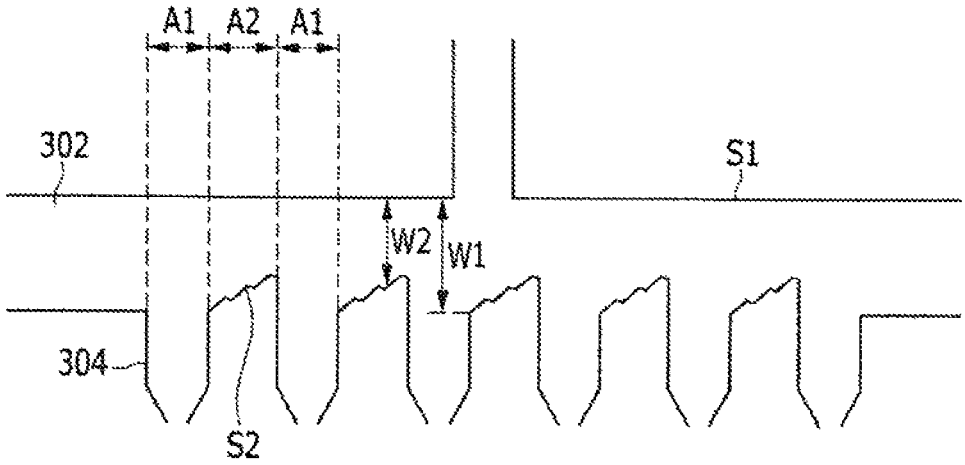
Figure 7:
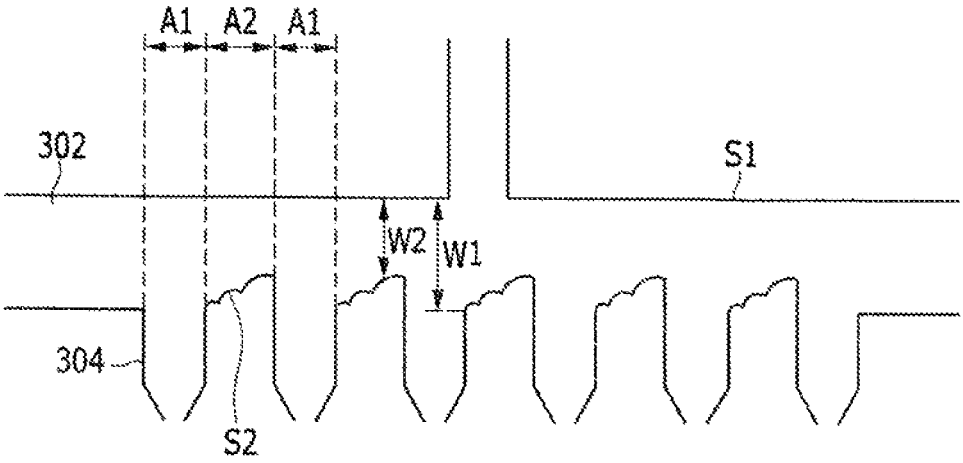
Figure 8:
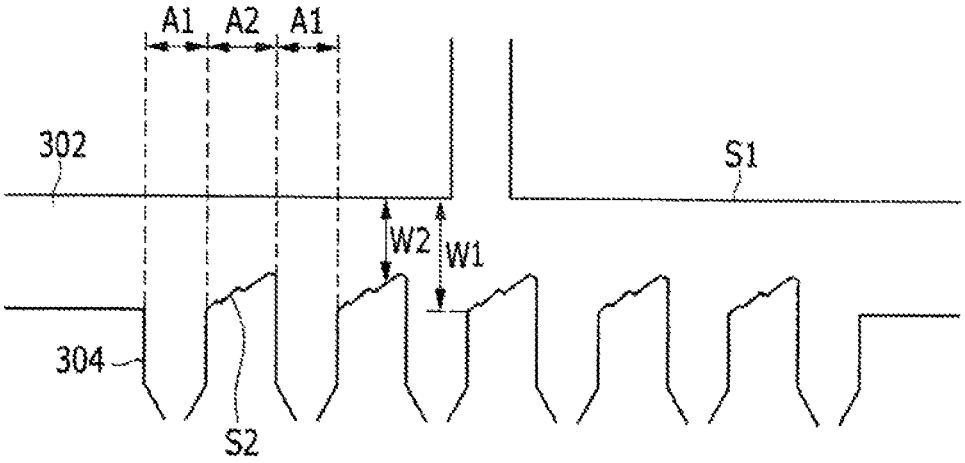

In addition, as shown in FIG. 5 to FIG. 9 the inclined portion S2 may have a stepped shape. In these cases, the widths of the respective steps may be spaced apart from each other at regular intervals, or may be gradually widened, as shown in FIG. 7 and FIG. 8, or narrowed (not shown).

Figure 9:
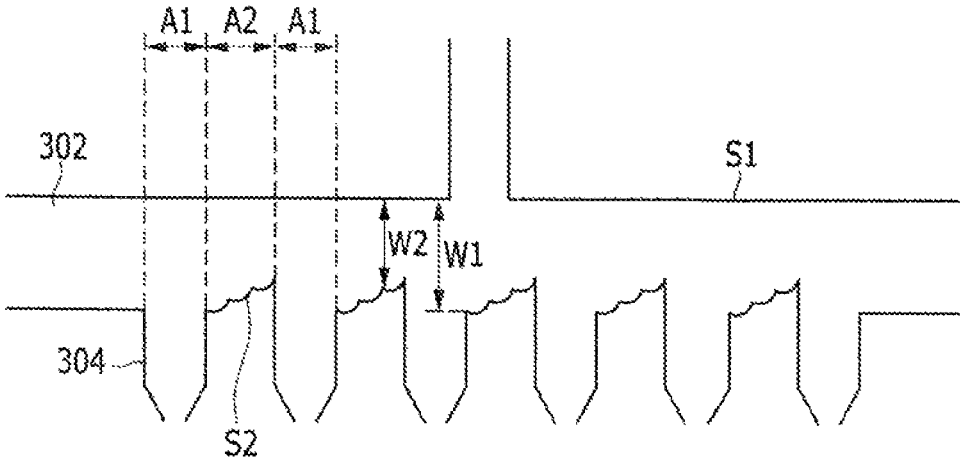

In the exemplary embodiments illustrated in FIG. 5 and FIG. 7, the steps of the inclined surface S2 may have a convex shape, and as illustrated in FIG. 6 and FIG. 8 the steps of the inclined surface S2 may have a saw tooth shape, but as shown in FIG. 9, the inclined surface S2 may be formed to have concave steps.

In this case, a ratio of a width W1 of a first portion A1 and the smallest width W2 of second portions A2 may be W1:W2=10:8.2 to 9, and an angle formed by an extended inclined surface of the inclined portion S2 and the upper surface S1 of the distribution path 302 may have a slope less than 30°.

In the exemplary embodiment illustrated in FIG. 5 to FIG. 9, the steps are formed by dividing the inclined portion S2 into three, but may be divided into two or four.

In the above-described exemplary embodiments, the distribution path of the second portion A2 is inclined such that the width of the second portion S2 is gradually changed.

Figure 10:
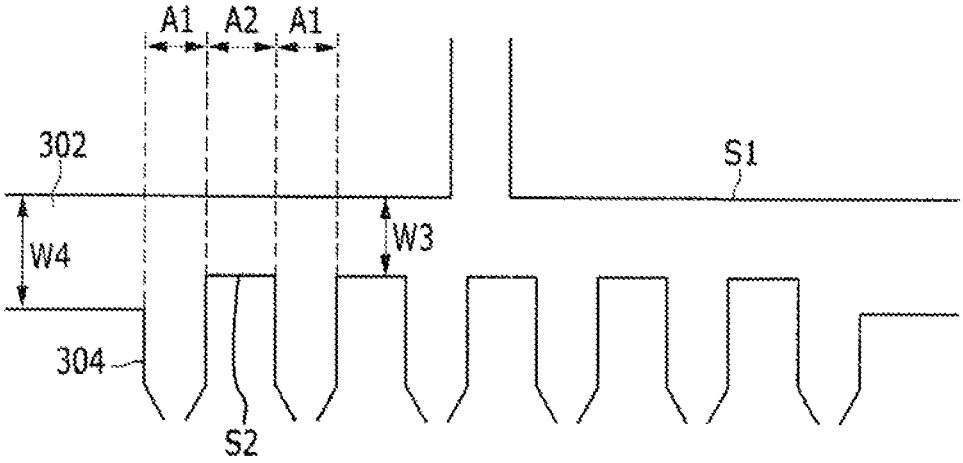

Referring now to FIG. 10, the distribution path of the second portion A2 is formed to have a constant width by forming a surface that is parallel with the upper surface S1.

Although a width W3 of the second portion A2 is narrower than a width W4 of the distribution path 302 through which a gas is injected, a pressure difference is generated due to the gas flow, thereby causing an eddy current so that particles and bubbles in the nozzle can be easily eliminated.

In this case, a ratio of the width W4 of the distribution path and the width W3 of the second portion A2 may be W4:W3=10:8.2 to 9.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A printing device, comprising:

a solution tank;

a nozzle unit including a distribution path connected to the solution tank through a first pipe, the nozzle unit including a plurality of nozzles connected to a lower surface of the distribution path;

a gas supply connected to the nozzle unit through a second pipe; and a discharge unit connected to the nozzle unit through a third pipe, wherein the distribution path comprises a central portion corresponding to a plurality of first portions and a plurality of second portions alternately arranged and lateral end portions arranged at opposite ends respectively of the central portion while being adjacent to and connected to the second and third pipes respectively, wherein the first and second portions respectively have different distribution path widths due to differences in a profile of the lower surface of the distribution path at locations corresponding to the second portions between the first portions as compared to a profile of portions of the lower surface of the distribution path at locations corresponding to the lateral ends of the distribution path.

2. The printing device of claim 1, wherein the first portions correspond to the nozzles and the second portions correspond to areas between the nozzles.

3. The printing device of claim 1, wherein a ratio of a width of the distribution path at locations corresponding to each first portion to a width of the distribution path at locations corresponding to each second portion is 10:8.2 to 9.

4. The printing device of claim 3, wherein a width of the distribution path within each second portion is uniform throughout each second portion.

5. The printing device of claim 1, wherein the lower surface of the distribution path comprises an inclined portion that is inclined with respect to an upper and opposite surface of the distribution path that is connected to the first pipe.

6. The printing device of claim 5, wherein an angle formed by an extended inclined surface of the inclined portion of the lower surface and the upper surface is less than 30° .

7. The printing device of claim 5, wherein the inclined surface has a curved surface.

8. The printing device of claim 5, wherein the inclined surface forms steps.

9. The printing device of claim 8, wherein the widths of the steps are spaced apart from each other at regular intervals.

10. The printing device of claim 8, wherein the width of each succeeding step is gradually changed.

11. The printing device of claim 5, wherein the inclined portion is a straight line.

12. The printing device of claim 8, wherein each step comprises a concave surface on the lower surface that faces the upper surface of the distribution path.

13. The printing device of claim 1, wherein the discharge unit separates gas from particles that have been removed from the nozzle unit.

14. The printing device of claim 1, further comprising a fourth pipe connecting the gas supply to the solution tank to emit solution from the solution tank to the first pipe and then to the nozzle unit by pressing the solution with a pressure.

15. The printing device of claim 1, the printing device to remove particles from the nozzles by generating eddy currents in a vicinity of the nozzles by producing a pressure difference of gas flowing through the distribution path by having inclined second portions that cause a width of the distribution path within the nozzle unit to periodically increase or decrease.

16. The printing device of claim 1, wherein a width of the distribution path within each second portion is uniform throughout each second portion.

17. A printing device, comprising:

a solution tank;

a nozzle unit including a distribution path connected to the solution tank through a first pipe and a plurality of nozzles connected to the distribution path;

a gas supply connected to the nozzle unit through a second pipe; and a discharge unit connected to the nozzle unit through a third pipe, wherein the distribution path comprises first portions and second portions that respectively have different widths, wherein a width of the distribution path at locations corresponding to each second portion is gradually narrowed toward the third pipe.

18. The printing device of claim 17,wherein a width of the distribution path at locations corresponding to each first portion is larger than a width of the distribution path at locations that correspond to each second portion.

19. The printing device of claim 18, wherein the width of each second portion is gradually changed.

20. The printing device of claim 17, wherein a ratio of the width of the distribution path at locations corresponding to each first portion to a smallest width of the distribution path at locations corresponding to each second portion is 10:8.2 to 9.

* * * * *